United States Patent [19]

Yokota et al.

[11] Patent Number: 4,787,597

[45] Date of Patent: Nov. 29, 1988

[54] CLOTH FACED FORM FOR FORMING CONCRETE

[75] Inventors: Takayoshi Yokota, Kodaira; Shigekazu Horiya, Sagamihara; Kenjiroh Tanaka, Zushi, all of Japan

[73] Assignee: Kabushiki Kaisha Kumagaigumi, Fukui, Japan

[21] Appl. No.: 162,228

[22] Filed: Feb. 29, 1988

Related U.S. Application Data

[63] Continuation-in-part of Ser. No. 863,565, May 15, 1986, Pat. No. 4,730,805.

[30] Foreign Application Priority Data

May 28, 1985 [JP] Japan ..... 60-115139
May 28, 1985 [JP] Japan ..... 60-79781[U]
Jul. 3, 1985 [JP] Japan ..... 60-101467[U]

[51] Int. Cl.[4] ..... E04G 9/10; B28B 7/36

[52] U.S. Cl. ..... 249/113; 249/141; 249/189; 264/86; 425/84

[58] Field of Search ..... 249/112–114, 249/141, 189; 264/86, 87, 102; 425/84, 85, 812

[56] References Cited

U.S. PATENT DOCUMENTS

| | | | |
|---|---|---|---|
| 2,321,277 | 6/1943 | Boyle | 425/85 |
| 2,349,469 | 5/1944 | Sloan | 210/347 |
| 2,474,721 | 6/1949 | Billner | 425/85 |
| 2,671,940 | 3/1954 | Billner | 425/85 |
| 2,688,175 | 9/1954 | Billner | 425/85 |
| 3,600,771 | 8/1971 | Dyrander | 425/85 |
| 3,844,527 | 10/1974 | Scott | 249/189 |
| 4,203,714 | 5/1980 | Wenander | 425/85 |
| 4,730,805 | 3/1988 | Yokota et al. | 249/113 |

FOREIGN PATENT DOCUMENTS

| | | | |
|---|---|---|---|
| 52-137136 | 11/1977 | Japan . | |
| 60-43528 | 3/1985 | Japan . | |
| 486121 | 12/1975 | U.S.S.R. | 425/85 |
| 735451 | 8/1955 | United Kingdom . | |
| 798091 | 7/1958 | United Kingdom . | |
| 1145499 | 3/1969 | United Kingdom . | |
| 2156416 | 10/1985 | United Kingdom . | |

*Primary Examiner*—Jay H. Woo
*Assistant Examiner*—James C. Housel
*Attorney, Agent, or Firm*—Graybeal, Jensen & Puntigam

[57] ABSTRACT

Concrete forms comprising a first cloth sheet permitting surplus water and air contained in concrete cast in the form to pass therethrough but capable of blocking the passage of the concrete, a second cloth sheet permeably secured to the first sheet, permitting the surplus water and air to pass between and through the first and second sheets and to be absorbed into the second sheet as well as the first sheet, and a support plate to which the second sheet is bonded as by adhesive or thermal bonding acting through only part of the thickness of the second sheet, leaving as water and air permeable throughout the remainder of the second sheet, all of the first sheet, and the interspace therebetween, such being effective as flow paths for surplus water and air to exhaust from the concrete cast in the form to thereby shorten the cure time and improve the strength of the concrete when cured.

5 Claims, 4 Drawing Sheets

CLOTH FACED FORM FOR FORMING CONCRETE

BACKGROUND OF THE INVENTION

CROSS REFERENCE TO RELATED APPLICATION

This application is a continuation-in-part of our copending U.S. patent application Ser. No. 06/863,565, filed May 15, 1986, now U.S. Pat. No. 4,730,805 and entitled "Form For Forming Concrete".

FIELD OF THE INVENTION

This invention relates to a form for forming concrete.

DESCRIPTION OF THE PRIOR ART

Ideally, concrete used for forming concrete formings of structures constituting buildings, constructions or the like has a water content sufficient for the hydration of the cement contained in the concrete. However, since concrete with only such water content is typically very low in fluidity, it does not reach all the corners of space wherein it is to be placed or cast. Thus, concrete containing more water than is necessary for the hydration of the cement is actually used.

Well known are forms for forming concrete with sheathing boards made of plastic, steel or wood to define the space wherein the concrete is cast or poured. With such forms the concrete being cast hardens while containing the surplus water therein.

Concrete containing a great deal of surplus water develops initial strength relatively slowly after casting thereof so that concrete work is delayed In addition, such concrete contracts considerably during drying thereof so that the formings are liable to have cracks, thereby giving rise to such problems that high quality concrete formings, excellent in durability and water tightness, cannot be attained.

Further, air in the form of bubbles is mixed in concrete during the pouring thereof Some of these bubbles, however ascend through the concrete naturally or by compaction while the concrete is still flowable, and escape to the atmosphere, while some of the rest remain in the concrete and between the concrete and the sheathing boards to form cavities which also degrade the durability and water tightness of the concrete formings.

Prior to this invention, forms which may exhaust the surplus water and bubbles from the cast concrete as much as possible have been proposed in order to solve such problems.

As disclosed in Japanese Patent Public Disclosure (KOKAI) No. 137136/1977 this prior form comprises a plate member provided with a plurality of through-holes and one or more filter sheets bonded to said plate member, said filter sheets being made of such materials as to permit water to permeate therethrough, but block the permeation of cement grains or the like.

According to this prior form, the space wherein the concrete is to be cast is defined by said filter sheets, and when the concrete is cast in the space, the surplus water contained in the concrete and the air mixed in said concrete during the casting thereof are exhausted to the outside of the form by way of said filter sheets and the through-holes in said plate member.

Now, as described in said Japanese Patent Disclosure (KOKAI), in case of a single filter sheet, the filter sheet, or in case of a plurality of filter sheets, the innermost filter sheet contacting said plate member is respectively bonded to said plate member on all portions except for said through-holes, and a plurality of said filter sheets are further bonded to each other on all portions except for the portions corresponding to said through-holes.

Thus, the surplus water and air contained in the cast concrete are exhausted outside the form substantially through said through-holes which occupy but a small portion of the whole surface area of said filter sheet or said plate member and the filter sheet portions corresponding to the through-holes so that the amount of said surplus water and air exhausted is relatively small. Thus, the amount of surplus water and air capable of being exhausted while the concrete is still flowable prior to hardening thereof is quite limited.

To reduce substantially the remaining water and air not exhausted, it has been proposed to increase the number of said through-holes provided in said plate member. However, an increase in the number of through-holes makes it difficult for the plate member to have the strength necessary to resist the lateral pressure exerted on the plate member by the cast concrete Also, the plate member, if it is to have more through-holes and the strength necessary to resist the lateral pressure, should be thicker and stronger However, the former causes an increase in the weight of the form, which preferably is light, and, on the other hand, the latter results in raising the cost of the concrete form.

Also, in Japanese Patent Public Disclosure (KOKAI) No. 43528/1985 is described a form in which a porous material having permeability and water absorbing properties is applied to a metal plate. According to this form, the surplus water contained in the cast concrete is exhausted along said porous material to the outside of the form while air is ejected through the holes of said porous material to the atmosphere Said porous material, however, becomes choked with the adhesive used in applying the porous material to the metal plate, thereby causing flow paths for the surplus water and air to be restricted and reducing the amount of water and air exhausted.

SUMMARY OF THE INVENTION

Accordingly, an object of the present invention is to provide a form capable of exhausting a large amount of the surplus water and air contained in the cast concrete during a short period of time, without reducing the strength of the plate supporting the sheet or sheets and without requiring the plate to be relatively large in thickness or have particularly high strength.

Forms for forming concrete according to the present invention comprise a first cloth sheet contacting the cast concrete and permitting surplus water and air to pass through paths or gaps in said first sheet, but blocking the passage of said concrete, a second cloth sheet to which said first sheet is secured in an open or gapped manner, as by stitching, permitting the water and air to flow in the interstitial spaces between the first and second sheets and permitting surplus water to be absorbed into the second sheet as well, and a support plate to which said second sheet is in turn secured, as by adhesive or thermal bonding in the portions thereof in direct contact with the support plate.

According to the present invention, the first cloth sheet provides paths or gaps for flow of the surplus water and air emerging from the cast concrete, the concrete being in direct contact with said first sheet.

These paths or gaps are available by reason of the structural gaps between and within the plurality of yarns, fibers or filaments constituting the cloth sheet, enabling flow or seepage of surplus water and air to the outside of the first sheet through these paths or gaps.

Said first sheet, for example, is not impregnated with adhesive for fixing said first sheet to said plate, but said second sheet is partly impregnated with the adhesive. Thus, said gaps in said first sheet are not choked with the adhesive so that the whole first sheet and also the gaps between said first and second sheets are utilized as flow paths of the surplus water and air. Thus, a great deal of surplus water and air may be exhausted for a short period of time.

Also, since the second sheet partly impregnated with adhesive preferably has relatively coarse structural density, said second sheet may be more easily impregnated with more adhesive Use of more of the impregnated adhesive increases the holding force on said first sheet which said plate should possess and permit said first sheet to be more effectively removed from the molded concrete surface upon removal of the form after curing of the concrete.

Thus, the provision of flow paths for permitting relatively large amounts of the surplus water and air to flow between the plate and the cast concrete dispenses with any need for a flow path for said surplus water and air in said plate and thus eliminates the need for providing channels which would otherwise weaken the strength of the plate.

BRIEF DESCRIPTION OF THE DRAWINGS

These and other objects and features of the invention will become more apparent from the following description of preferred embodiments of the invention with reference to the accompanying drawings, in which.

DESCRIPTION OF THE PREFERRED EMBODIMENTS

Figure 1:
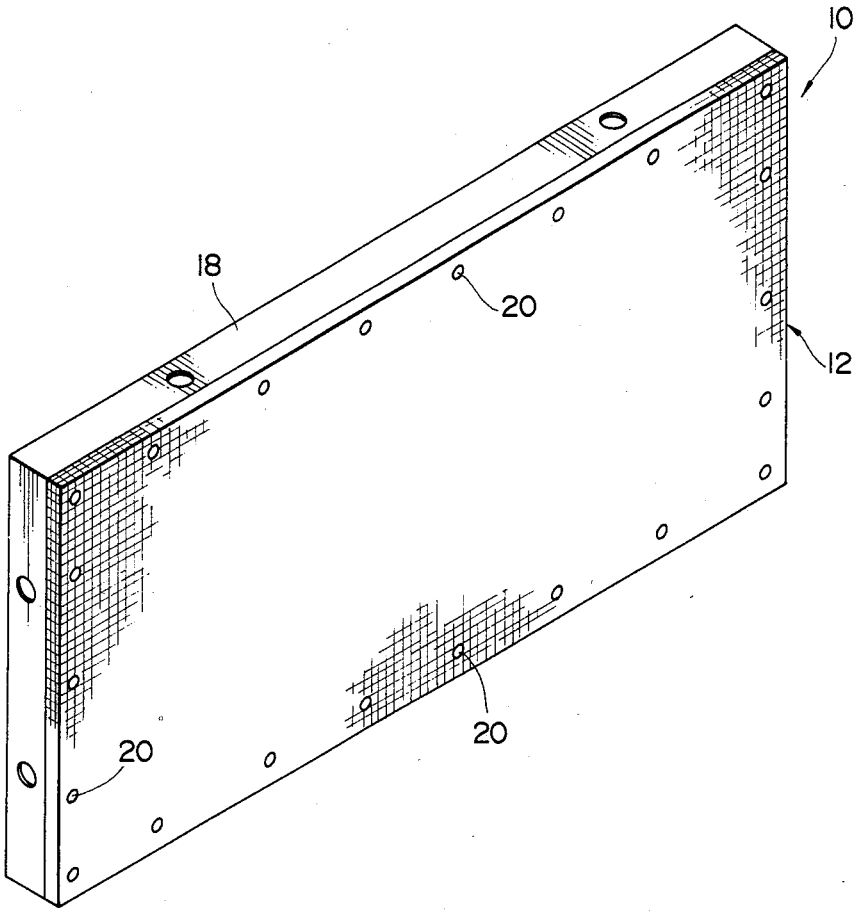
FIG. 1 is a perspective view showing a form according to the present invention.
Figure 2:
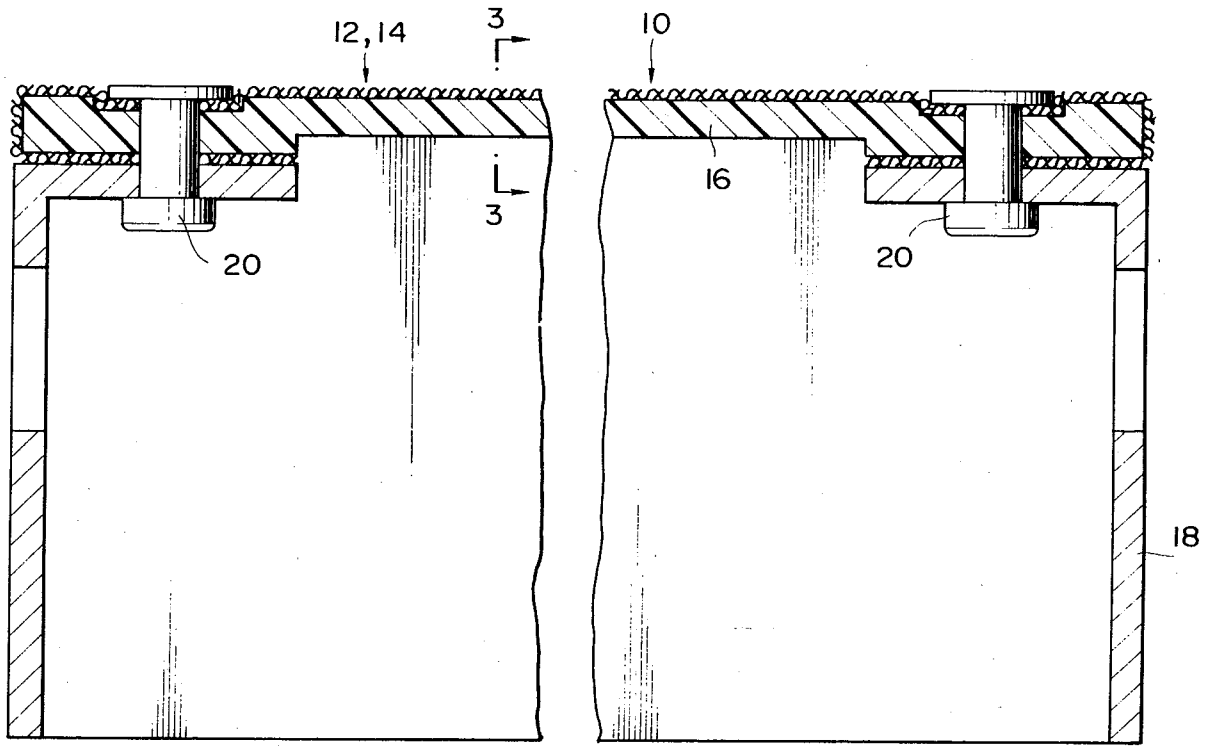
FIG. 2 is an enlarged-scale fragmentary sectional view of the form shown in FIG. 1, showing the nature thereof both as to the horizontal and vertical cross-section thereof.

Referring to FIGS. 1 and 2, a form 10 according to the present invention comprises a first sheet 12 contacting concrete (not shown) to be poured or cast, a second sheet 14 secured to the first sheet and a plate 16 secured to the second sheet.

A plurality of forms 10 are used by joining vertically and laterally so as to define at least one wall of concrete moldings to be molded, for example, the wall of a building. To interconnect the forms 10, a frame-like template 18 is placed on one surface of the plate 16 opposite to the other surface where said first and second sheets 12, 14 are disposed thereon The template 18 is fixed to the plate 16 by means of a plurality of rivets 20 penetrating the first sheet 12, second sheet 14, plate 16 and template 18. A secured body of the first and second sheets 12, 14 secured to each other and having an area larger than that of the plate 16 is bent at the peripheral sandwiched between the plate 16 and the template 18. The plate 16 and the template 18 may be made respectively of glass fiber reinforced plastic (FRP) and iron materials, for example. The plate 16 may be made of synthetic resin materials.

The concrete to be cast is used under such condition as to contain water of more than the necessary amount for hydration of cement, i.e. with surplus water, so as to reach all the corners of the pour space in part defined by the first sheet 12. Also, when the concrete is cast into said space, air in the form of bubbles is mixed in said cast concrete. The surplus water and air degrade the quality of concrete castings.

Figure 3:
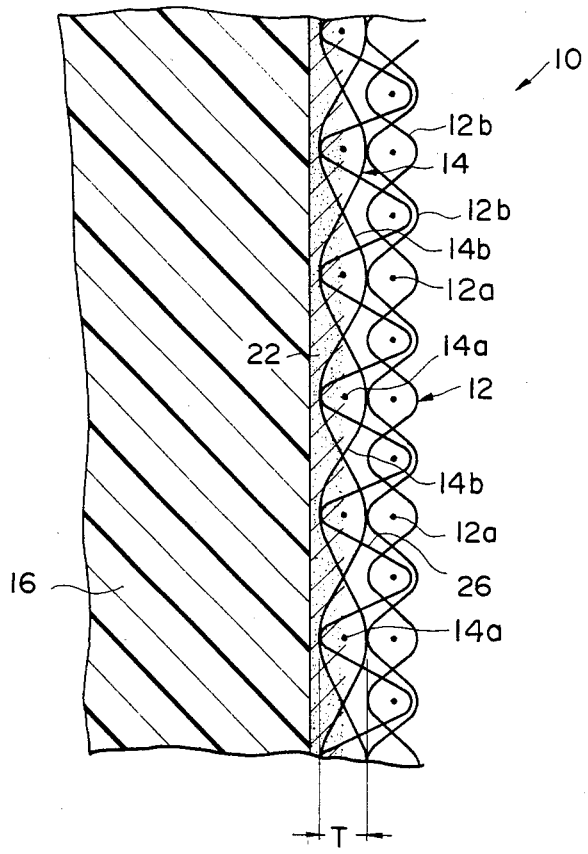
FIG. 3 is a greatly enlarged detail view of a typical vertical cross section, taken along line 3—3 of FIG. 4, and somewhat conceptual in character, further showing the nature of the form shown in FIG. 1.

Referring now to FIG. 3, the cloth sheet 12 of woven fabric is preferably made of synthetic fiber having high alkali resistance, water resisting property, weather resisting property and relatively high tensile strength. The cloth sheet 12 is preferably of a plain weave design. The weft **12*a* and warp 12*b* of cloth sheet 12** each comprises a plurality of 1000 denier polyester threads spaced at 24 threads per inch.

The second cloth sheet 14 is secured to the first sheet 12 on one surface and secured to the plate 16 on the other surface by way of adhesive 22, such as those made of synthetic resin, to permit the surplus water passing through the meshes of the first sheet 12 to impregnate said sheet 14. The second sheet 14 may be constituted of cloth made of synthetic fibers similar to the first sheet 12. The second sheet 14, like the first cloth sheet 12, is of a plain weave design. The weft **14*a* of the second sheet 14 similarly comprises 1000 denier polyester threads at 24 threads per inch However, the warp 14*b* of the second sheet 14** comprises 1000 denier polyester threads spaced at 12 threads per inch.

By making the second sheet 14 of cloth having coarse meshes, i.e. large structural gaps between weft **14*a* and warp 14*b* as in the embodiment shown, the second sheet 14 may be easily impregnated throughout one surface thereof with an appropriate waterproof adhesive as shown in FIG. 3. This increases the adhesion between the plate 16 and the second sheet 14 and thus the binding force between the first sheet 12 and the plate 16. Thus, when the form is separated from the concrete by removing the first sheet 12 from the concrete casting, the first sheet 12 is prevented from exfoliation from the plate 16. The adhesive 22 is desirably allowed to be impregnated up to about half of the thickness T of the second sheet 14, leaving at least the other half open to absorb and act as a conduit for exhaustion of surplus water and air which has passed through the first sheet 12**.

Figure 4:
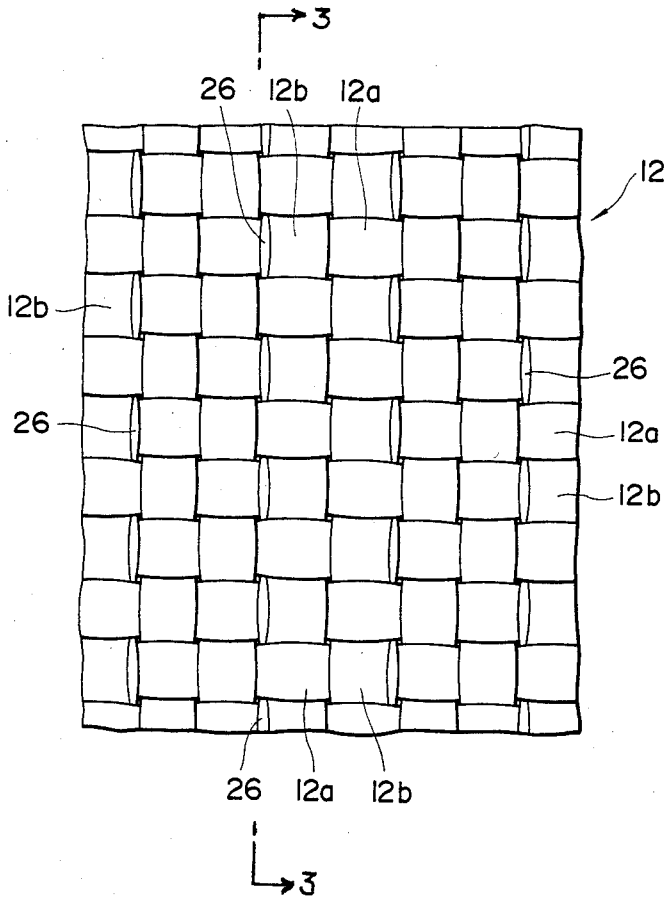
FIG. 4 is a greatly enlarged front elevational view of the form shown in FIG. 1, showing particularly the stitching between the sheets.

Referring now to FIG. 4, the first and second sheets 12, 14 are suitably secured to each other, as by strings 26 made of synthetic fibers having relatively high tensile strength for example. Suitably the strings 26 may be in the form of stitching, applied throughout the surfaces of the sheets 12, 14 in sufficiently close spacing to avoid any substantial dislocations between the interfacing surfaces of the cloth sheets 12, 14, such as, for example, by stitching in vertical rows with the rows of stitching spaced about 2.0 mm apart.

The surplus water leaching through the concrete being poured in said space and contacting the first sheet 12, and the air contained in the mix, permeate through the first sheet 12. However, concrete, i.e. the mixed grains containing cement, aggregates, and water necessary for hydration of cement or the like, are blocked from permeation into the first sheet 12 and remain in the pour space. Also, some of the surplus water and air permeating through the first sheet 12 are introduced further into the gap between the first and second sheets 12, 14 by way of the first sheet 12 and furthermore into the second sheet 14 to the extent the second sheet 14 is not impregnated with adhesive.

The surplus water and air permeated through the first cloth sheet 12, the gap between the first and second sheets 12, 14 and the second sheet 14 are free to flow below and about the form 10 under the action of gravity. More particularly, the surplus water and air permeated through the cloth constituting the first sheet 12 are allowed to flow through the structural gaps between a plurality of warps 12*b* (or wefts 12*a*) of the cloth, the yarn gaps between a plurality of yarns (not shown) constituting these warps and wefts, and the fiber gaps between the plurality of fibers constituting said yarns. These situations apply similarly to the surplus water and air permeating through the second cloth sheet 14.

Openings throughout the first cloth sheet 12, and throughout the second sheet 14, and between the first and second sheets 12, 14 throughout the interfacing surfaces thereof, provide conduits for a great amount of surplus water and air to flow and thus be exhausted to the outside of the form in a short period of time.

By the exhaustion of the surplus water the water-cement ratio of the concrete is reduced so that the development of initial strength in the concrete is promoted. As a result, the form may be removed earlier from the concrete and the cure time shortened Also, the degree of reduction of said water-cement ratio is the greatest on the concrete surface contacting the first cloth sheet 12 so that concrete castings with extremely hard surfaces are formed. Furthermore, the exhaustion of air avoids so-called air pits on the surface of said concrete castings. Further, since the first and second cloth sheets 12, 14 act as an adiabatic material for the cast concrete, they contribute to the prevention of crack. generation on the concrete surface due to temperature differences incurred in the formed concrete works in winter, summer, high-land, mountainous regions or the like.

The cloth sheets 12, 14 do not lose their air and water permeability in the course of use and are repeatedly reusable.

It will be appreciated that, although specific embodiments of the invention have been described herein for purposes of illustration, various modifications may be made without departing from the spirit and scope of the invention. Accordingly, the scope of the invention is not limited except as by the following claims.

What is claimed is:

1. A form for forming concrete comprising:

a first cloth sheet permitting surplus water in concrete cast in said form to pass through said first sheet, but capable of blocking the passage of said concrete;

a second cloth sheet secured to said first sheet by strings disposed over substantially the entire area of said first sheet and permitting said surplus water to be absorbed into said second sheet; and a plate secured to said second sheet.

2. A form for forming concrete as claimed in claim 1, wherein said second sheet is secured to said plate by means of adhesive.

3. A form for forming concrete as claimed in claim 2, wherein said adhesive is absorbed into said second sheet only up to about half of the thickness thereof.

4. A form for forming concrete as claimed in claim 1, wherein said second sheet has coarser mesh than that of said first sheet.

5. A form for forming concrete as claimed in claim 1, wherein said cloth is made of synthetic fiber.

* * * * *